United States Patent [19]

Damman

[11] 4,142,394

[45] Mar. 6, 1979

[54] APPARATUS FOR FORMING CIRCULARLY BENT ARTICLES FROM A STRAIGHT PROFILED STRIP

[75] Inventor: Cornelis C. Damman, Diemen, Netherlands

[73] Assignee: Holland Mechanics B.V., Diemen, Netherlands

[21] Appl. No.: 821,967

[22] Filed: Aug. 4, 1977

Related U.S. Application Data

[62] Division of Ser. No. 742,679, Nov. 17, 1976, Pat. No. 4,054,982.

[30] Foreign Application Priority Data

Nov. 21, 1975 [NL] Netherlands ..... 7513654
Mar. 12, 1976 [NL] Netherlands ..... 7602645

[51] Int. Cl.[2] ..... B21D 7/00

[52] U.S. Cl. ..... 72/220; 72/386; 72/297; 72/15

[58] Field of Search ..... 72/14, 15, 22, 36, 214, 72/312, 386, 418, 461, DIG. 11, DIG. 21, 297, 301, 220

[56] References Cited

U.S. PATENT DOCUMENTS

| | | | |
|---|---|---|---|
| 2,036,745 | 4/1936 | Diehl | 72/220 |
| 2,178,926 | 11/1939 | Brickman et al. | 72/36 |
| 2,288,273 | 6/1942 | Enghauser | 72/214 |
| 2,922,324 | 1/1960 | Honerkamp et al. | 72/15 |
| 3,466,914 | 9/1969 | Gilchrist | 72/214 |
| 3,618,353 | 11/1971 | Meyer | 72/214 |

*Primary Examiner*—Michael J. Keenan
*Attorney, Agent, or Firm*—Haseltine, Lake & Waters

[57] ABSTRACT

Apparatus for forming circular rims for bicycle wheels from metal profiled strip material in which first strip pieces are cut to a length corresponding to the circumferential length of the rims, curved end portions are formed on each strip piece, and each strip piece is introduced into a three-roll ring rolling apparatus. After the strip piece has been worked up to the trailing curved end portion thereof, the adjustable middle roll of the rolling apparatus is shifted a small distance towards the two outer rolls into a position corresponding with a substantially bending-free passage of the trailing curved end portion of the strip piece.

3 Claims, 8 Drawing Figures

APPARATUS FOR FORMING CIRCULARLY BENT ARTICLES FROM A STRAIGHT PROFILED STRIP

CROSS-RELATED APPLICATION

This Application is a division of co-pending Application Ser. No. 742,679 filed Nov. 17, 1976 now renewed as Pat. No. 4,054,982.

BACKGROUND OF THE INVENTION

The invention relates to apparatus for forming circularly bent ring members from elongated metal profiled strip material, particularly for making rims of spoke wheels such as bicycle wheels.

In the conventional methods of forming bicycle wheel rims an elongated profiled strip of, for example, steel or aluminum is introduced into a three-roll rolling apparatus and bent into a spiral comprising a plurality of convolutions. Thereafter, the feed end portion of the spiral is cut-off, and strip lengths equal to the circumferential length of the rims to be formed are cut from the spiral and the ends of these strip lengths are welded together. Thereafter, the spoke receiving holes are drilled in the rim, and subsequently, the rim is polished. This method has the disadvantage that it can only be performed by skilled personnel, and that the manufacture, for instance by extrusion, of the extended profiled strip material and the forming of the circularly bent rims therefrom must be carried out in the same factory if the uneconomical transport of the profiled strip material of great length is to be avoided. Another disadvantage of the known methods is that in connecting the ends of the rim pieces cut from the spirally bent profiled strip these ends have to be transversely bent towards each other whereby stresses and consequently lateral deformations may occur in the formed rim which must be corrected later when the spokes are tensioned.

SUMMARY OF THE INVENTION

The invention has for its main object to provide for carrying out a method of forming circularly bent ring members from elongated metal strip material which eliminates the above-mentioned disadvantages of the conventional methods and which provides further advantages as will be discussed herein below.

Another object of the invention is to provide a simple apparatus which allows the above-mentioned method to be carried out by unskilled operators.

The method carried out by the apparatus generally comprises the steps of first cutting strip pieces of the required length from the straight profiled strip material, pre-forming the ends of each strip length with a bending apparatus to form at each of said ends a short curved end portion of a curvature substantially corresponding to the circular shape of the ring member to be formed, introducing the strip piece with one of said curved end portions into a three-roll ring rolling apparatus, and, after the strip piece has been worked at least upto the other, trailing curved end portion of the strip piece, shifting the adjustable middle forming roll of the rolling apparatus a small distance towards the two outer forming rolls thereof to a position corresponding to a substantially bending-free passage of said trailing curved end portion through the forming rolls.

In accordance with the invention the shifting of the middle forming roll may be effected by automatic control means without interruption of the rolling process.

Preferably, the strip length is twice completely passed through the rolling apparatus.

If the middle forming roll of the rolling apparatus would not undergo the said small displacement, a small flat area would occur at the place where the main body of the originally straight strip length passes into the trailing curved end portion due to the decreased bending stress occurring in the strip material running through the rolls when this curved end portion enters between the rolls. This irregularity is corrected by this roll displacement as is also any irregularity which may occur at the transition of the leading curved end portion into the main body of the strip. In this manner it appears to be possible to bend the strip piece into a circular ring with sufficient accuracy without the necessity of cutting-off the beginning and end portions of the strip. Furthermore, after the bending operation the strip ends are in line with each other so that they may be connected by simple means such as by pins inserted into holes in the end faces of the strip ends. A welded connection is not required.

The invention has the further advantage that the bending and forming of the rims from the strip pieces need not be done by the manufacturer of the profiled strip material but may be carried out by the final customer, such as the bicycle manufacturer. The transport of the relatively short straight strip pieces cut to size is, of course, considerably simpler than the transport of ready bent rims or of strip material of great length, and the storage of such strip pieces requires less space.

The mode of forming spoke wheel rims enables the spoke receiving rim holes to be made in the straight strip pieces, by punching, for example. This, of course, is simpler than making these rim holes in the formed bent rims as was necessary hitherto.

The invention also permits the strip pieces to be polished or otherwise finished prior to the bending operation, which also is considerably simpler for straight strips than for ready formed rims.

The manufacturer of the final product, such as the bicycle manufacturer, thus receives the straight profiled strip pieces in fully finished condition so that he himself may form the rims therefrom in a simple manner. In this operation the strip pieces are not bent spirally but to circular flat rings so that the strip ends can be easily connected without any lateral deformation of the rim.

The invention is particularly directed to a bending apparatus for bending the curved end portions of the strip pieces and to a three-roll ring rolling apparatus for circularly bending the strip pieces, which apparatuses the manufacturer of the final product may have at his disposal and which, as described herein below, can be easily operated by unskilled personnel.

The radius to which a strip is bent when introduced into the rolling apparatus depends not only on the adjustment of the shiftable middle forming roll of the apparatus but also on the properties of the material of the strip such as the hardness, the yield strength and the percentage of elongation thereof. Therefore, if the material of a strip is not homogeneous but shows local variations, which may easily occur, this may lead to unroundness of the formed ring. It has already been proposed to avoid such deviations from the exact circular shape by the use in a rolling apparatus of means for checking and correcting the radius of the bent profile strip as it leaves the forming rolls. A known device of this kind includes a measuring roll adapted to be resiliently urged against the bent strip and spring mounted for substantially radial movement relative to the strip, which measuring roll actuates a control means for the adjustment means of the rolling aopparatus.

The known device of this kind has a single measuring roll attached to an arm pivotably supported in the apparatus frame. This device is not adapted to directly determine the radius of the curvature of the bent profile strip leaving the forming rolls.

In accordance with the invention this disadvantage may be overcome in that the checking and correcting means include an assembly of two outer sensing rolls spaced a fixed distance from each other and connected by a movable mounted support, and a central measuring roll intermediate the sensing rolls, which measuring roll is resiliently movable relative to the support in a path substantially coinciding with the normal bisecting the line connecting the centers of both outer sensing rolls. Spring means operating on the support and the measuring roll are provided for holding the three rolls in engagement with the strip leaving the forming rolls. Preferably one sensing roll is formed by the stationary outer forming roll of the rolling apparatus on the discharge side thereof so that the measurement of the bending radius and the correction thereof, if necessary, takes place as close as possible behind the forming rolls. This three-point sensing of the bent strip shows deviations from the desired bending radius directly as displacements of the center measuring roll relative to the support connecting both other sensing rolls, which displacements can be used with known means for actuating the control means of the rolling apparatus.

BRIEF DESCRIPTION OF THE DRAWINGS

The invention will be further explained with reference to the drawings illustrating preferred embodiments of the bending apparatus and of the three-roll ring rolling apparatus for performing the method of the invention.

DESCRIPTION OF A PREFERRED EMBODIMENT

Figures 1, 4:
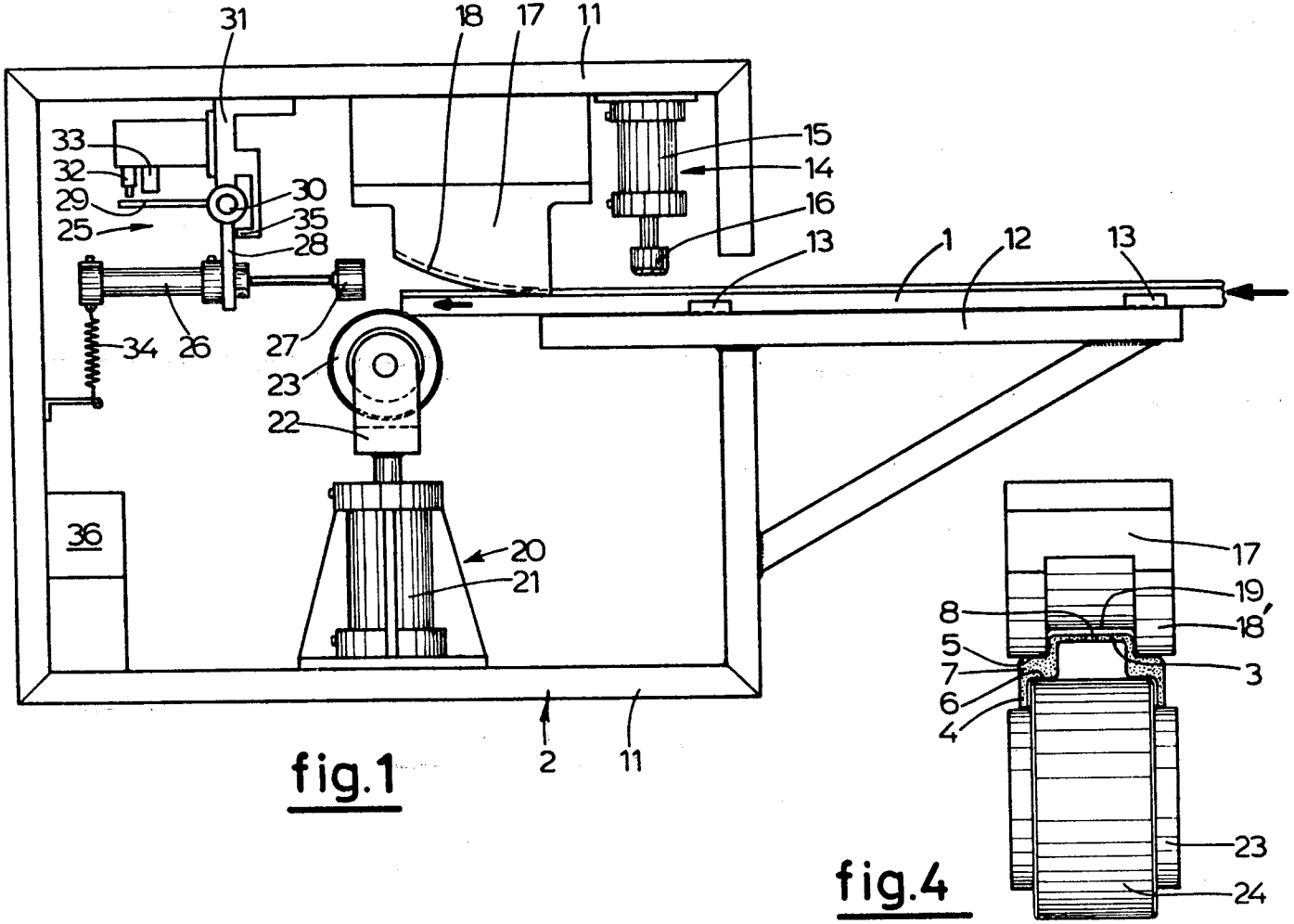
FIG. 1 is a schematic elevation of the bending apparatus for rounding the strip ends, with the different parts in their rest position.
FIG. 4 is a section on an enlarged scale on the line IV—IV of FIG. 3 and shows the profile of the bending template and that of the press roll.
Figure 5:
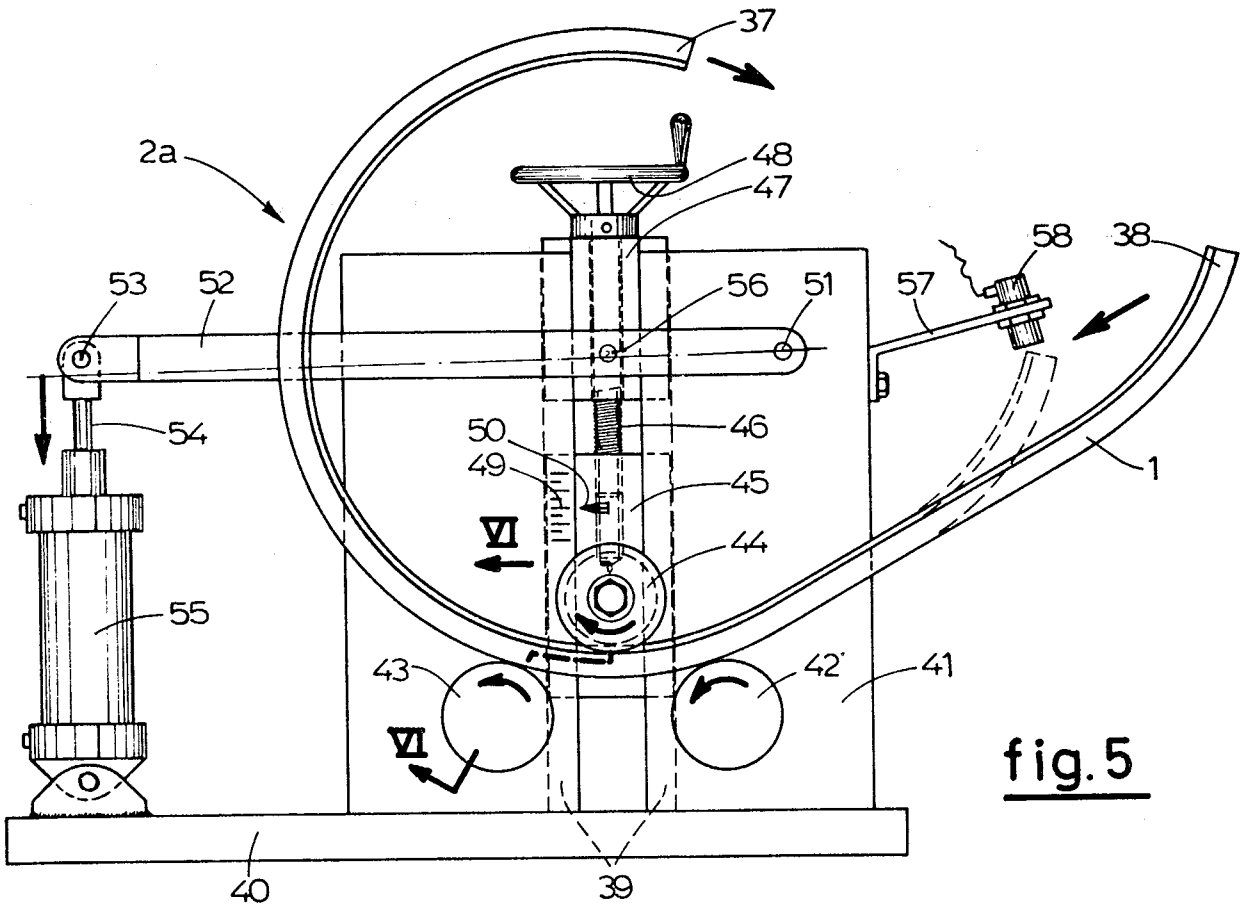
FIG. 5 is a schematic elevation of the three-roll ring rolling apparatus for bending a strip length with the pre-formed curved end portions.
Figure 6:
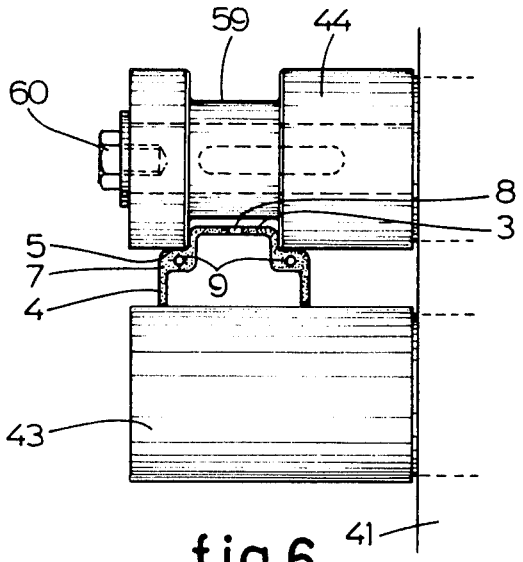
FIG. 6 is a section on an enlarged scale through two rolls of the apparatus of FIG. 5 with an interposed strip as seen on the line VI—VI of FIG. 5.
Figure 7:
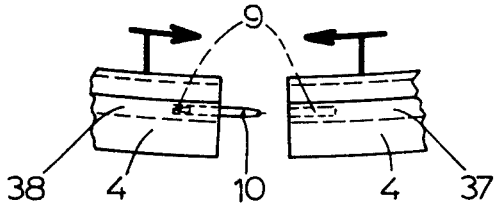
FIG. 7 is a side view of the ends of the bent strip length before they are attached to each other.

The pressing apparatus 2 of FIG. 1 and the three-roll ring rolling apparatus 2*a* of FIG. 5 are intended for forming bicycle wheel rims from straight lengths of strip material 1 cut to size. These strip lengths 1 are cut from an extended profile strip extruded from a suitable aluminum alloy and having a cross-sectional shape as illustrated in FIG. 4 and 6. This rim profile includes a web 3 and side flanges 4 of stepped shape with a thickened flange portion 7 enclosed between an outer shoulder 5 and an inner shoulder 6 (FIG. 4). The web 3 of the straight profile strip 1 has holes 8 punched therein for receiving the wheel spokes and the valve of the tube to be positioned around the finished rim. In the end faces of the strip lengths 1, longitudinal holes 9 are drilled in the thickened flange portions 7, and pins 10 for connecting these ends may be inserted into these holes after the rim has been shaped (FIG. 7). Finally, the straight strip lengths have been polished and finished so that the rims require no further treatment after forming.

Figure 2:
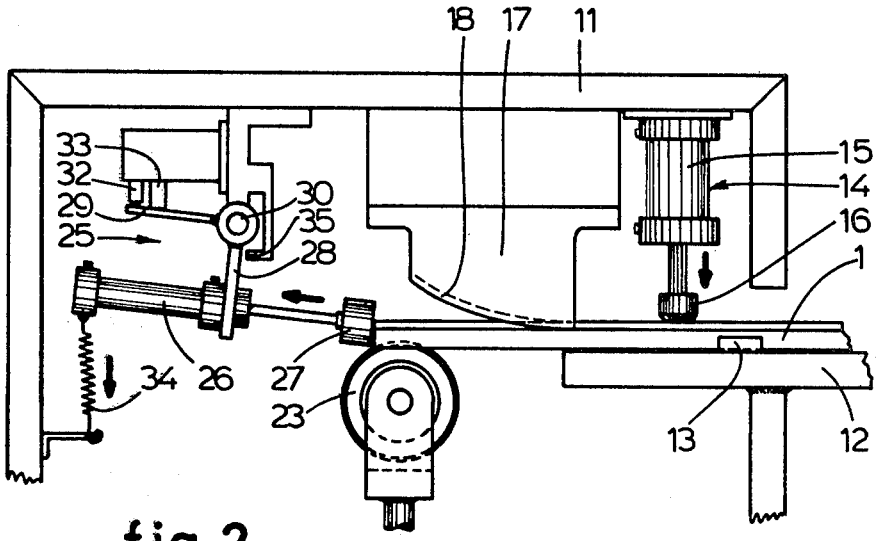
FIG. 2 shows the upper portion of the bending apparatus of FIG. 1 after a strip length introduced into the apparatus has been clamped therein.

The pressing apparatus illutrated in FIG. 1 has a rectangular frame 11 supporting at one side an elongated horizontal table 12 on which guide members 13 are arranged for laterally enclosing a strip length 1 positioned on the table 12 and forming a longitudinal guide for this strip length. Above the table 12 and close to the rear end thereof a pneumatically actuated clamping device 14 is arranged which comprises a clamping block 16 vertically movable by an air cylinder 15. Upon actuation of the cylinder 15 the clamping block 16 is pressed against an underlying strip length 1 to hold the strip of the table 12 against longitudinal sliding movement (FIG. 2).

Behind the clamping device 14 an exchangeable bending template 17 is secured to the frame 11, said template having a downwardly directed, longitudinally curved, profiled template face 18. As shown in FIG. 4, the template face has a longitudinal slot 19 enclosed between two side portions 18', the web 3 of the strip length 1 fitting between these side portions 18' without contacting the bottom of the slot 19 and these side portions 18' engaging the shoulders 5 of the rim profile. The bending tamplate 17 is so arranged that the front end thereof is in slightly overlapping registry with the rear end of the table 12 and is at such elevation above the table that an introduced strip length 1 is received with its web 3 in the slot 19 of the bending template 17. From this front end of the bending template the template face 18 etends rearwardly and upwardly in a curve of progressively decreasing radius, the radius of the rearmost portion of the template face 18 being equal to the radius of the circular shape to which the strip length 1 finally has to be bent.

Below the rear end of the bending template 17 a press device 20 is disposed on the frame, said device including a pneumatic, vertical actuating cylinder 1 having a piston with an upwardly extending piston rod carrying a fork 22 at its upper end in which an exchangeable press roll 23 is mounted for free rotation FIG. 4 shows that the press roll 23 has a radially prejecting body portion 24 of such width that this body portion fits between the rim flanges 4 and may engage the shoulders 6 of the rim profile without engaging the inner edges of the rim flanges 4.

In the path of the strip 1, as determined by the guide members 13, an abutment device 25 is attached to the frame 11 behind the bending template 17. The device 25 has an abutment block 27 reciprocably movable by an air cylinder 26 carried by one arm 28 of a two-armed lever 28, 29 pivotable mounted on a horizontal shaft 30 of a support 31 secured to the frame 11. In its rest position of FIG. 1 the horizontal arm 29 of the lever 28, 29 is spaced a small distance below a microswitch 32 and a stop 33 carried by the support 31. A tension spring 34 attached to the rear of the cylinder 26 urges the arm 28 against a stop 35 formed on the support 31.

The microswitch 32 forms part of an electrical control system housed in a casing 36, said control system comprising known means (not further shown) which after closing of the switch 32 operate the air cylinders 15, 26 and 21 in a predetermined time-sequence to be described herebelow.

Figure 3:
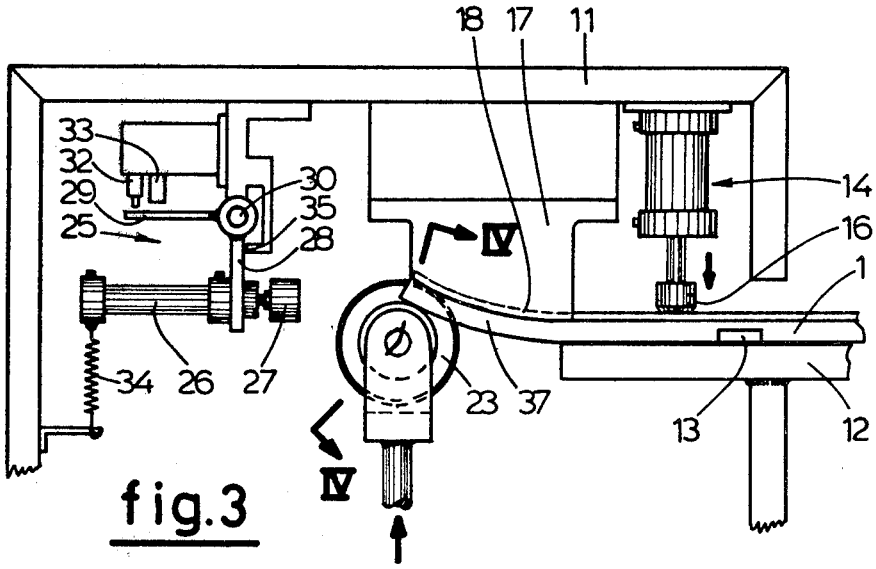
FIG. 3 is a similar view as FIG. 2 at the end of the press stroke.

The described pressing apparatus works as follows. When the strip length 1, shown partially introduced in FIG. 1, is further advanced between the bending template 17 and the press roll 23 until stopped in its end position by the abutment block 27, this block together with the cylinder 26 is turned a small angle about the shaft 30 until the arm 29 abuts the stop 33 and at the same time operates the microswitch 32. The electrical control system actuated thereby is so designed that with short time intervals first the cylinder 15 of the clamping device 14 is actuated so as to lower the clamping block 16 for clamping the strip length 1 against the table 12 (FIG. 2). Immediately thereafter, the cylinder 26 of the abutment device 25 is actuated for retracting the abutment block 27 from the end of the strip length 1 out of the path of the press roll 23 and also causing the spring 34 to swing the block 27 back to the horizontal position. Subsequently, the cylinder 21 of the pressing device 20 is actuated for rasing the press roll 23, whereby this press roll engages the end of the strip length 1 and presses the same against the template face 18 of the bending tamplate 17. Thereby, the curved end portion 37 is formed at the one end of the strip length 1 (FIG. 3). After the press stroke of the press roll 23, this roll, the clamping block 16 and the abutment block 27 are returned to their initial rest positions of FIG. 1, whereupon the strip length 1 may be removed from the pressing apparatus and have its other end introduced into this apparatus for shaping this end into a second curved end portion 38 curved in the same direction. In the bending operations, the strip length 1 is engaged by the side portions 18' of the bending template 17 and the body portion 24 of the press roll 23 at the locaton of the shoulders 5 and 6 of the thickened flange portions 7 only whereby the cross-sectional shape of the strip is not deformed and the application of forces tending to spread the flanges 4 is avoided. Depending on the degree of springback of the bent end portion of the strip length 1 after retraction of the press roll 23, the radius of curvature of the rearmost portion of the template face 18 may be so selected that the curvature of the strip end is properly adapted to the radius of the final product.

After the end portions of the strip length 1 have been pre-formed in the described manner, the strip is introduced into the three-roll ring rolling apparatus **2*a* of FIG. 5. This apparatus has a base plate 40 carrying a machine frame 41. This frame supports two spaced outer rolls 42 and 43 for rotation about parallel horizontal axes, said rolls having smooth cylindrical surfaces of the same diameter. A block 45 is mounted for vertical sliding movement in the guideway 39 of the frame 41 and a middle or upper roll 44 is journalled in the block 45 also for rotation about a horizontal axis. Upon displacement of the block 45, the axis of the upper roll 44 moves in a vertical path normal to the line connecting the axes of the lower rolls 42 and 43 and intersecting said line midway of said axes. The rolls 42, 43 and 44** are each driven in a manner not shown.

A threaded bore of the block 45 receives a screw spindle 46 which is freely rotatably but axially non-slidably supported in a second block 47 slidably mounted in the same vertical guideways 39 of the frame 41 as the block 45. The upper end of the screw spindle 46 is provided with a handwheel 48 for turning the screw spindle for the accurate vertical adjustment of the upper forming roll 44, a scale 49 and pointer 50 indicating the position to which the roll 44 has been set.

A lever 52 has one end pivotally connected at 51 to the frame 41 and the other end of the lever at 53 is pivoted to the upper end of a piston rod 54 of a piston movable in an air cylinder 55 which is pivotally supported on the base plate 40. The lever 52 extends along the front side of the frame 41 and is pivotally connected to the slide block 47 by a coupling pin 56.

In its rest position the air cylinder 55 holds the lever 52 in the illustrated upper position, whereas the cylinder 55 upon its actuation pulls the lever end 53 a small distance downwardly. Thereby the lever 52 through the coupling pin 56 presses the slide block 47 and thus also the slide block 45 with the upper roll 44 downwardly to a lower position closer to the stationary outer rolls 42 and 43.

A bracket 57 secured to the frame 41 supports a sensor 58 such as a proximity switch of known type, in a position adjacent the path of the curved rear end 38 of a strip length 1 introduced between the forming rolls of the apparatus. When the switch 58 responds to the passage of said strip rear end it actuates the air cylinder 55 through electric control means not shown, said control means including an adjustable time delay element, whereby the upper roll 44 is moved a small distance towards the stationary rolls 42 and 43, and after removal of the ready bent rim from the apparatus, the actuation of the air cylinder 55 is reversed again and the upper roll 44 is moved back upwardly into the rest position of FIG. 5.

As indicated in FIG. 6, the upper forming roll 44, unlike the lower rolls 42 and 43, is profiled and includes an annular recess 59 into which the web 7 of the rim may freely project so that the upper roll 44 only engages the shoulders 5 of the strip length 1, and the edges of the side flanges 4 engage the smooth lower rolls 42 and 43. If desired, the lower rolls 42 and 43 may be given a similar cross-sectional shape as the press roll 23 of FIG. 4. The upper roll 44 is retained by a nut 60 on its drive shaft so as to be easily exchangeable.

The described three-roll ring rolling apparatus **2*a* operates as follows: With the rolls 42, 43 and 44 continuously driven in the direction of the arrows of FIG. 5 and with the lever 52 in the upper position, a strip length 1 of which both ends have been preformed to curved end portions 37 and 38 by the pressing apparatus of FIG. 1, is introduced with one end portion 37 between the forming rolls 42, 43 and 44 of the rolling apparatus, the strip length being guided by the upper roll 44 engaging the strip profile. Previously, this upper roll has been so adjusted by the handwheel 48, that the three rolls in known manner bend the straight strip length into a circular shape of a radius corresponding to a peripheral length equal to the length of the strip. The leading curved end portion 37 not only enables the strip to be introduced between the rolls but also permits this strip end portion to assume the desired curvature and to merge into the adjoining circularly bent body portion of the strip substantially without deviation from the required radius. When during the passage of the strip length 1 between the rolls the trailing curved end portion 38 reaches the lower roll 42, the bending stress occurring in the strip material clamped between the three forming rolls is decreased and, thus, a lower bending force is applied to the strip which would cause a small local flattening at the transistion of the initially straight strip body into this trailing curved end portion 38. In order to correct for this, the control means for the air cylinder 55 are so adjusted that after the trailing end of the strip length has passed the proximity switch 58, the control means actuate the air cylinder 55 whereby the upper roll 44 is moved a small distance downwardly at the moment the trailing end portion 38 reaches the lower roll 42. Thereby the decrease of the stress in the strip material which would otherwise occur when this curved end portion 38** runs into the rolls, is compensated and the said flattening is substantially avoided so that after a full passage of the strip length the latter has been bent with sufficient accuracy into the desired circular shape with the strip ends properly aligned.

In the above described situation a single passage of the strip length through the rolling apparatus is theoretically sufficient. In practice, however, it often appears difficult to actuate the air cylinder 55 at exactly the right moment. For this reason, it is preferred that the strip length bent in the first passage through the forming rolls is passed once more through the rolls with the upper roll 44 moved to the lower position. In that case the cylinder 55 may also be actuated after the passage of the trailing end portion 38, the correction of the flat strip area then being effected during the second passage. In this second passage any irregularity following the leading end portion 37 is also corrected. The distance through which the upper roll 44 is lowered should be so selected that during the second passage the main body of the strip which has been bent to the correct radius will pass freely or under light bending stress only through the rolls without undergoing a second permanent bending deformation. A correct adjustment of the angle through which the lever 52 has to be moved may be obtained, for example, with adjustable abutment means (not shown).

After the bent rim has been formed, both aligned strip length ends may be connected to each other, as illustrated in FIG. 7, by inserting pins 10 into the holes 9, whereafter the rim is ready to be further processed in the manufacture of spoke wheels.

The apparatus of FIG. 1 and 5 only occupies little space and may be easily operated by unskilled personnel, since the only manipulations to be performed are introducing each strip length in the correct position into the pressing apparatus twice and subsequently introducing the strip length with its preformed curved end portions into the rolling apparatus.

Figure 8:
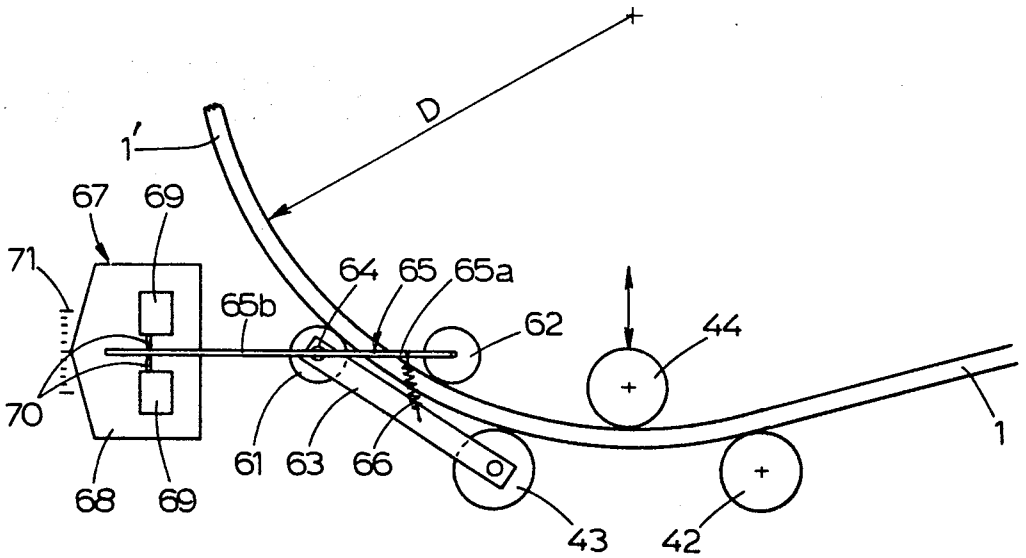
FIG. 8 is a schematic view of a radius checking and correcting apparatus for use with the rolling apparatus.

FIG. 8 schematically illustrates an apparatus for checking and correcting, if necessary, the radius D of the bent portion 1' of a strip length 1 leaving the forming rolls 42, 43 and 44 of the rolling apparatus of FIG. 5 into which the strip length 1 has been introduced. In practice, it appears that with a predetermined adjustment of the middle forming roll 44 small variations of this radius may occur due to irregularities in the material of the strip length 1 or irregularities in the rolling apparatus itself like play and unroundness of the rolls or the drive and mountings thereof.

The checking and correcting apparatus of FIG. 8 in principle includes an assembly of three sensing and measuring rolls 43, 61 and 62, the shafts of the rolls 43 and 61 being spaced a fixed distance from each other and connected by a supporting arm 63 whereas the intermediate measuring roll 62 is movable relative to the supporting arm 63 in a path at least approximately coinciding with the normal bisecting the line connecting the axes of the rolls 61 and 43. When the three rolls are kept pressed against the bent strip length portion 1', the distance between the point of contact of the middle measuring roll 62 and the chord connecting the points of contact of the sensing rolls 61 and 43 is a measure for the bending radius D. In principle, the measuring roll 62 may engage the strip on the same side, or, as illustrated, on the opposite other side as both sensing rolls 61 and 43. In the illustrated embodiment, the stationary forming roll 43 is used as the one sensing roll in order that the measurement of the radius D is taken as close as possible behind the set of forming rolls 42, 43 and 44. For this purpose, the supporting arm 63 is pivoted to the shaft of the roll 43, the supporting arm 63 at its other end carrying a shaft 64 on which the sensing roll 61 is freely rotatable. Furthermore, a two-armed lever 65 is rotatably journalled on this shaft 64, one arm **65*a* of said lever at its end carrying the freely rotatable measuring roll 62. Between the lever arm 65*a* and the supporting arm 63 acts a tension spring 66 thus keeping the sensing roll 61 pressed against the outer side of the bent strip portion 1' and the measuring roll 62 pressed against the inner side thereof. Though the measuring roll 62, when the lever 65 is pivoted, describes an arc about its pivot 64, this arc substantially coincides with the above-mentioned straight line normal to the arm 65, if the latter has a sufficient length. The deflection of the lever 65** relative to its position corresponding with the correct value of the radius D therefore indicates the degree of deviation of the measured valve of the radius from said correct value in one sense or the other.

The other arm **65*b* of the lever 65 extends outwardly and cooperates with a control means 67 carried by the frame of the rolling apparatus. This means 67 includes a base plate 68 on which two microswitches 69 are mounted at opposite sides of the lever arm 65*b*, the actuating pins 70 of the microswitches extending normal to the arm 65*b* and enclosing this arm with adjustable play. By positioning the microswitches 69 or their actuating pins 70 at a greater or smaller distance from each other the correction tolerance can be increased or decreased. The base plate 68 is adjustable in a direction normal to the arm 65*b*, and the position of the base plate can be read on a scale 71**.

The microswitches 69, when actuated by the arm **65*b*, control the adjustment means for the slide block 45 carrying the middle forming roll 44 of FIG. 5. To that effect, the screw spindle 46 may be connected to a suitable electric drive (not shown). Upon the occurrence of a deviation from the desired bending radius D the one or the other microswitch 69 is actuated and provides a signal which causes the electric drive of the screw spindle 46 to adjust the middle forming roll 44** in a correcting sense.

By a displacement of the base plate 68 along the scale 71 the rolling apparatus may be adjusted to a different bending radius D of the strip lengths 1 to be bent.

Instead of the microswitches 69 other means for determining the deflection of the lever 65 may be used, such as electronic distance measuring means, for example.

While the invention has been illustrated and described with reference to a specific embodiment thereof, it will be understood that other embodiments may be resorted to within the scope of the following claims.

What is claimed is:

1. A bending apparatus for forming curved end portions on a straight piece of metal strip material of predetermined cross-sectional shape comprising a substantially horizontal table having a front and rear end;

longitudinal guide means on said table for slidably receiving said straight strip piece;

a curved stationary bending die having a downwardly turned die face, said die face having a forward end and said die face extending in a curve rearwardly and upwardly from said forward end, said bending die being mounted adjacent the rear end of said table in line with said longitudinal guide means and with the front end of said die face at an elevation above the plane of said table for allowing said metal strip when placed on said table in said guide means to be moved forwardly just below said die face forward end with minimum vertical clearance abutment means disposed towards the rear of said bending die and in line with said guide means, said abutment means being mounted for movement between a forward operation position, in which the strip placed on said table with its forward end face against the abutment means occupies a selected position relative to said bending die, and a retracted rear position;

first drive means for moving said abutment means between said two positions;

clamping means arranged above said table and movable between an operating position for clamping a strip placed in said guide means against said table, and a rest position retracted from said table;

second drive means for moving said clamping means between said two positions thereof:

movably mounted press means arranged rearwardly of said rear end of said table and below said bending die for vertical movement towards and away from said die and adapted to engage the forward end of the strip clamped on said table to press and bend an end portion of said strip against said die face of said bending die;

third drive means for moving said press means towards and away from said bending die; and control means activated by said abutment means when the latter is contacted by the forward end of a strip said control means when activated causing the successive operation of said second, first and third drive means, respectively.

2. The bending apparatus of claim 1 wherein said control means comprises a switch for its activation, said abutment means being movably supported for cooperating with said switch whereby when in the forward position of the abutment means a pressure is applied thereto by the forward end of the strip piece introduced into the apparatus, said switch is actuated by said abutment means.

3. A bending apparatus as claimed in claim 1 wherein said clamping means is positioned between said bending die and the rear end of the table to clamp the strip against the table at a location spaced from said die face.

* * * * *